United States Patent [19]

Oota et al.

[11] Patent Number: 4,728,090

[45] Date of Patent: Mar. 1, 1988

[54] BANKNOTE DISTRIBUTING AND DISPENSING MACHINE

[75] Inventors: Yoshihiko Oota; Yutaka Arai, both of Tokyo, Japan

[73] Assignee: Laurel Bank Machines Co., Ltd., Tokyo, Japan

[21] Appl. No.: 880,927

[22] Filed: Jul. 1, 1986

[30] Foreign Application Priority Data

Jul. 8, 1985 [JP] Japan ..... 60-149842

[51] Int. Cl.[4] ..... B65H 5/22

[52] U.S. Cl. ..... 271/7; 271/279; 271/298; 271/299; 271/69; 271/198; 221/252; 221/258; 221/262

[58] Field of Search ..... 271/300, 69, 198, 200, 271/267, 268, 272, 184, 207

[56] References Cited

U.S. PATENT DOCUMENTS 4,017,004 4/1977 Onoe et al. ..... 221/236 X
4,343,582 8/1982 Lundblad et al. ..... 414/43 X
4,363,584 12/1982 Kokubo ..... 221/252 X
4,382,594 5/1983 Weigel et al. ..... 271/7 X
4,511,795 4/1985 Wood et al. ..... 235/379
4,578,009 3/1986 Granzow et al. ..... 414/43
4,618,302 10/1986 Kokubo et al. ..... 414/43 X

FOREIGN PATENT DOCUMENTS 2145865 4/1985 United Kingdom ..... 271/298

*Primary Examiner*—Joseph J. Rolla
*Assistant Examiner*—David H. Bollinger
*Attorney, Agent, or Firm*—Fleit, Jacobson, Cohn & Price

[57] ABSTRACT

Two dispensing port mechanisms are arranged in parallel in a banknote distributing and dispensing machine. A distributing mechanism is provided to be selectively arranged at either one of two dispensing port mechanisms. A transmission mechanism is provided to transmit the movement of conveyor belts in the distributing mechanism to the conveyor belts of the selected dispensing port mechanism.

3 Claims, 6 Drawing Figures

BANKNOTE DISTRIBUTING AND DISPENSING MACHINE

BACKGROUND OF THE INVENTION

The present invention relates to a banknote distributing and dispensing mechanism provided in a banknote distributing and dispensing machine which is installed adjacent to a counter or the like of a bank and is adapted to distribute banknotes to a plurality of dispensing port mechanisms.

Conventionally, apparatuses which are known as teller's machines are installed adjacent to the counters of financial institutions such as banks, and such a teller's machine is disposed between or among a plurality of (for instance, two) tellers at a counter, and automatically supplies one teller with banknotes in the amount and denomination specified by the teller, or automatically effects handling operations such as the counting and rearranging of deposited banknotes.

A banknote dispensing mechanism in the aforementioned teller's machine generally has the function of supplying either of two neighboring tellers with banknotes in a specified amount by virtue of the operation of a dispensing machine body for dispensing banknotes in the amount and denomination specified, a dispensing port disposed between two counters and adapted to deliver banknotes fed from the machine body, and a distributing mechanism disposed between the dispensing port and the machine body and adapted to selectively distribute the banknotes to one of the two dispensing ports.

It is necessary for the machine body, the distributing mechanism, and the dispensing port of the aforementioned machine each to be provided with a conveying mechanism for receiving and dispensing banknotes, and these conveying mechanisms are each provided with such driving sources as motors for the driving thereof. A multiplicity of these driving sources occupy a large space inside a teller's machine, thereby restricting the number of banknotes that can be accommodated and resulting in increasing the cost of the machine.

In addition, if the system of supplying banknotes from one dispensing machine body to two dispensing ports is applied to an automatic cash dispenser operated by clients of the bank, there is a problem since a multiplicity of driving sources become necessary as in the case of the aforementioned teller's machine.

SUMMARY OF THE INVENTION

The present invention has been devised in the light of the aforementioned situation and has as its object the reduction to as practical a level as possible of the number of motors that are used as driving sources in enabling an automatic cash dispenser and the like to effect a predetermined operation.

To this end, in the present invention, a plurality of dispensing ports are arranged in parallel, a distributing mechanism for selectively distributing banknotes fed out from a banknote dispensing machine body to one of the dispensing ports is provided, the distributing mechanism being capable of moving in the direction of juxtaposition of the dispensing ports, and the drive system of the conveyor belt for conveying banknotes in the distributing mechanism and the drive system of a conveyor belt for conveying the banknotes in the dispensing port are selectively coupled to each other by means of a transmission mechanism.

By selectively connecting the drive system of the conveyor belt of the distributing mechanism with the drive system of the dispensing port mechanism via the aforementioned transmission mechanism, it becomes possible to dispense banknotes by driving the conveyor belts provided in the dispensing port mechanism without providing any special driving apparatus in said mechanism.

DESCRIPTION OF THE DRAWINGS

The present invention will now be described in detail with reference to the presently preferred embodiment illustrated in the accompanying drawings in which.

DESCRIPTION OF THE PREFERRED EMBODIMENTS

Figure 1:
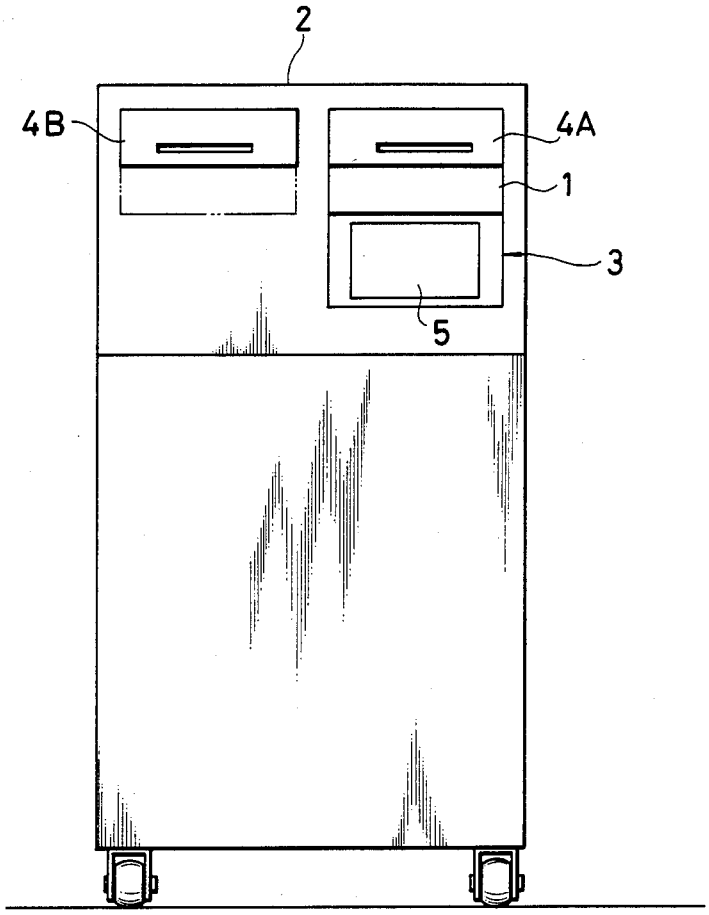
FIG. 1 is a front elevational view of a banknote dispensing machine.
Figure 2:
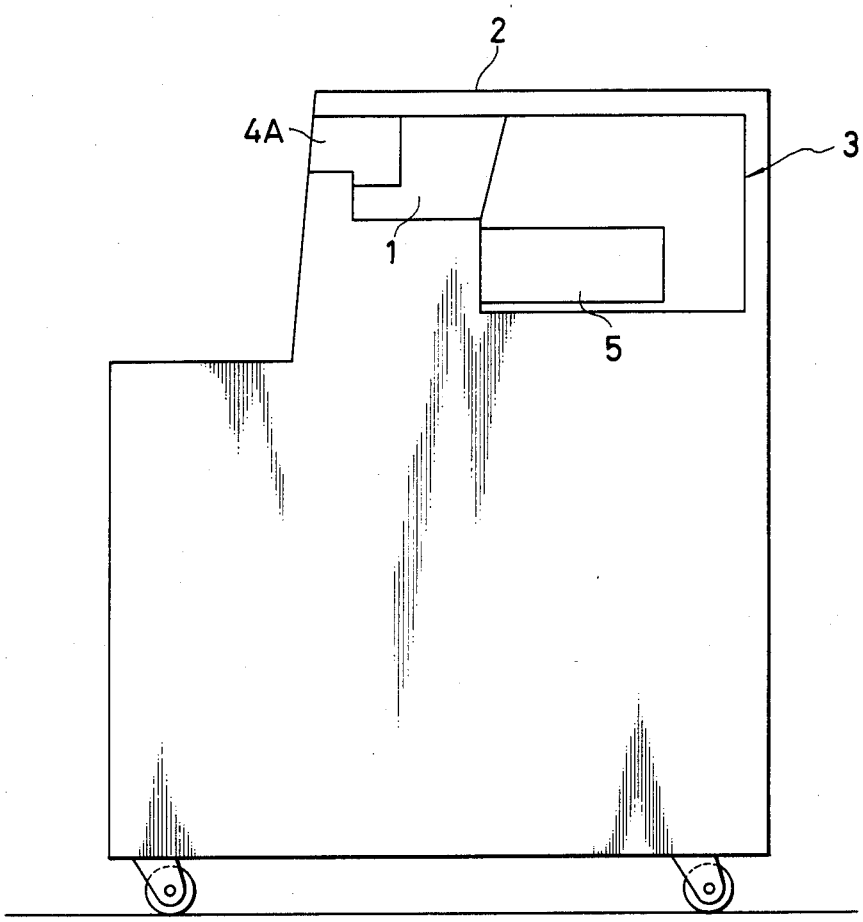
FIG. 2 is a side elevational view thereof.

The present invention will now be described in detail with reference to the embodiment shown in the accompanying drawings:

FIGS. 1 and 2 illustrate the external appearance of a banknote dispensing machine (teller's machine) having the function of depositing and dispensing banknotes and coins. A banknote distributing mechanism 1 according to the present invention is disposed between a banknote dispensing machine body 3 provided on the top of a teller's machine body 2 and dispensing port mechanism 4A, 4B juxtaposed in front of the machine body 2 and causes banknotes fed from the banknote pool 5 of the dispensing machine body 3 to be selectively supplied to the dispensing port mechanisms 4A or 4B. In addition, the dispensing machine body 3 is disposed in such a manner as to be positioned at the rear of the dispensing port mechanism 4A.

Next, a detailed description will be made of the arrangement of the distributing mechanism 1, the dispensing machine body 3, and the dispensing port mechanisms 4A, 4B.

Figure 3:
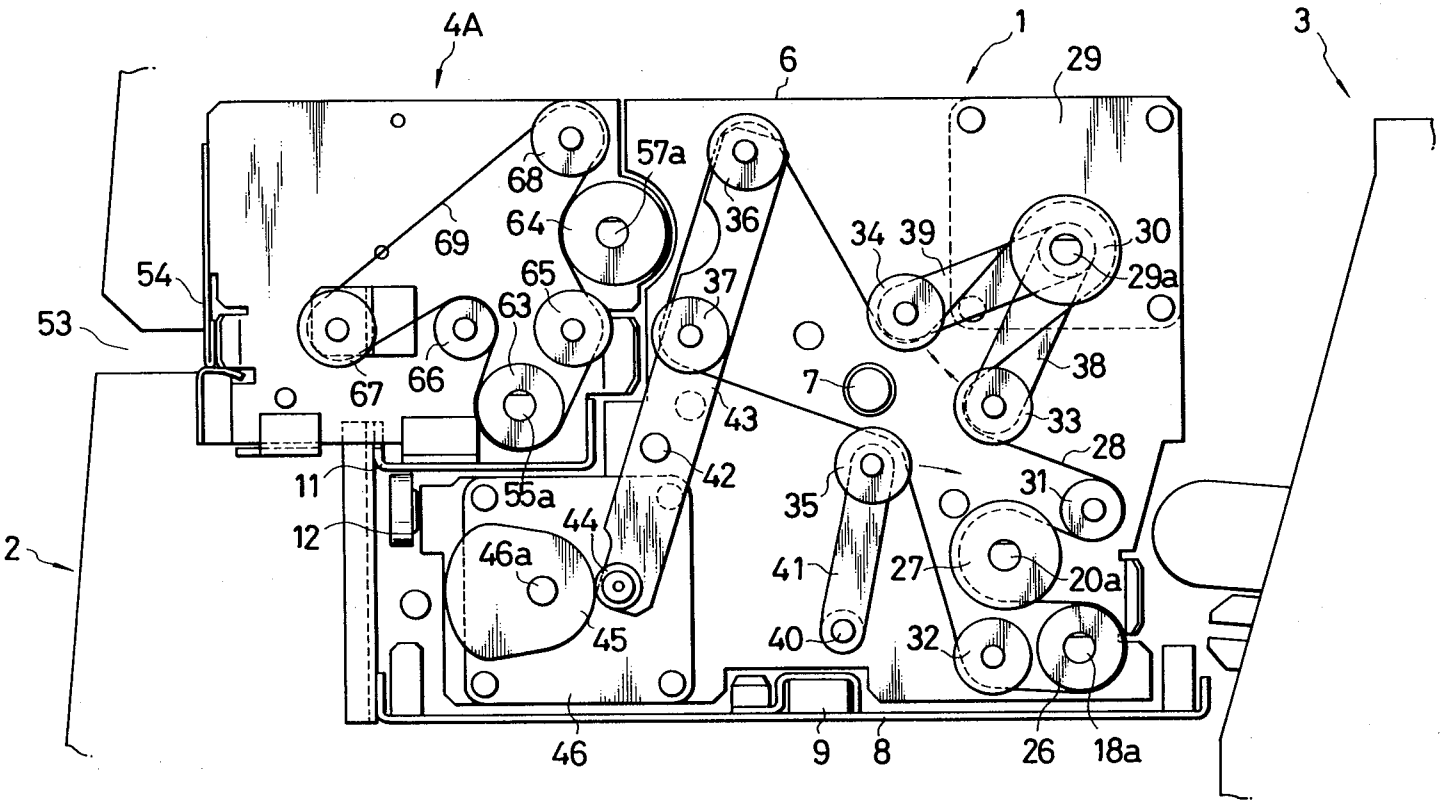
FIG. 3 is a side elevational view of a driving mechanism for conveyor belts as viewed in the axial direction of the rotating center thereof.
Figure 4:
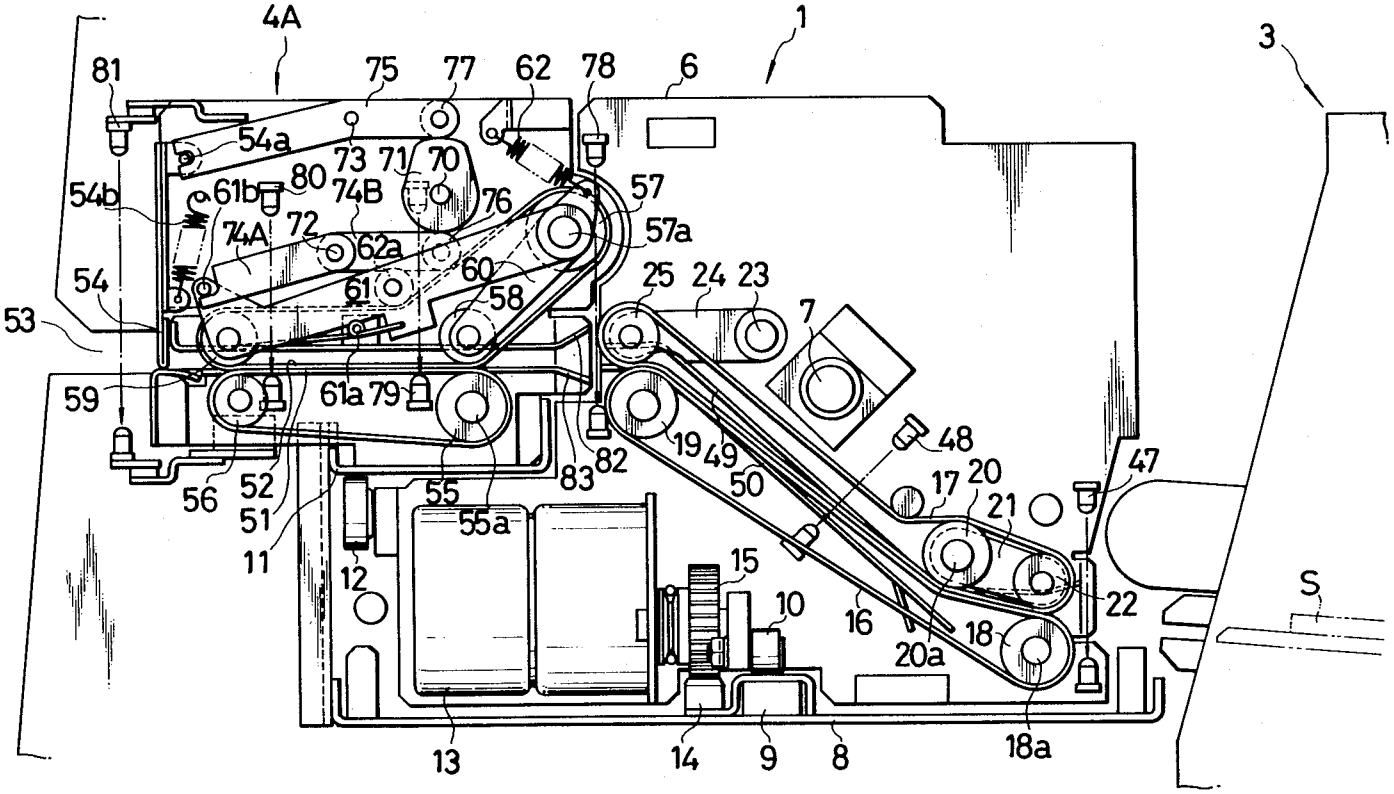
FIG. 4 is a side elevational view of the conveyor belts as viewed in the axial direction of the rotating center thereof.

As shown in FIGS. 3 and 4, the moving frame 6 of the distributing mechanism 1 is supported by the slide guide shaft 7 disposed in the machine body 2 horizontally along the direction of juxtaposition of the dispensing port mechanisms 4A, 4B, such as to be movable in the axial direction of the shaft. At the same time, the rotation of the moving frame 6 with the guide shaft 7 as a center is restricted by a guide roller 10 rotating on a slide guide block 9 supported by a distributing unit base 8 supported by the machine body 2 as well as a guide roller rotating on the underside of a dispensing port unit base 11 provided downwardly of the dispensing port mechanisms 4A, 4B. In addition, a slide motor 13 is mounted on the moving frame 6, and is adapted to be moved along the moving frame 6 in the axial direction of the slide guide shaft 7 by means of a rack 14 and a pinion 15 interposed between the slide motor 13 and the distributing unit base 8.

As shown in FIG. 4, the distributing mechanism 1 is provided with a conveying mechanism constituted by a lower conveyor belt 16 and an upper conveyor belt 17. The lower conveyor belt 16 is adapted to run by being trained around belt rollers 18, 19, while the upper conveyor belt 17 is adapted to run by being trained around a belt roller 20, a belt roller 22 rotatably supported by a belt arm 21 which is swingably supported by the shaft 20*a* of the belt roller 20, and a belt roller 25 rotatably supported by a belt arm 24 which is swingably supported by a shaft 23.

As shown in FIG. 3, at the ends of the shafts 18*a*, 20*a* of the belt rollers 18, 20 are connected timing pulleys (pulleys having concave and convex portions for engaging with a drive belt to be described later) 26, 27 rotating integrally with the shafts 18*a*, 20*a*, respectively. The power is transmitted to the timing pulleys 26, 27 by means of a drive belt 28 constituted by a double-sided timing belt (also called a cocked belt) or the like capable of engaging with pulleys such as the timing pulley 26 with either the obverse or reverse side thereof.

The drive belt 28 is driven by a belt-driving motor 29, and is trained around a timing pulley 30 provided on the output shaft 29*a* of the motor 29 and the timing pulleys 26, 27 and around fixed belt pulley 31, 32, tension pulleys 33, 34, and 35, and coupling pulleys 36, 37 provided at portions for coupling with a dispensing port-driving belt, which will be described later.

The tension pulleys 33, 34 are rotatably supported at the ends of the tension arms 38, 39 which are swingably supported on the output shaft 29*a* of the motor 29, while the tension pulley 35 is rotatably supported at the end of the tension arm 41 which is swingably supported on the shaft 40. The tension arms 38, 39, 41 are urged in the direction of the respective arrows as viewed in FIG. 3, by means of an urging means (not shown) such as a spring provided at the center of the rotation, thereby imparting tension to the belt 28.

The coupling pulleys 36, 37 are rotatably supported by a coupling arm 43 which is swingably supported on a shaft 42. The coupling arm 43 is adapted to be controlled by a cam 45 via a cam follower 44 provided at the lower end of the coupling arm 43. Additionally, the coupling arm 43 is urged clockwise as viewed in FIG. 4 about the shaft 42, i.e., in the direction away from the pulley of a dispensing port which will be described later.

Furthermore, reference numeral 46 in FIG. 3 denotes a cam-driving motor, which controls the coupling arm 43 by rotating the cam 45 on a shaft 46 unidirectionally from the position shown in FIG. 3 (the position of zero degrees). The function of the cam 45 will be described in detail later.

Reference numerals 47, 48 in FIG. 4 denote photosensors, which detect that banknotes have passed a specified position in the distributing mechanism. In addition, reference numerals 49, 50 denote guide plates for guiding from above and below the banknotes being conveyed by the conveyor belts 16, 17.

The dispensing port mechanisms 4A, 4B have the function of clamping the banknotes fed from the distributing mechanism 1 between the conveyor belts 51, 52, so as to deliver them from the dispensing ports 53, which are adapted to be opened and closed by a shutter 54. Incidentally, the lower conveyor belt 51 runs by being trained around belt rollers 55, 56.

The upper conveyor belt 52 runs by being trained around belt rollers 57, 58, and 59. The belt roller 58 is rotatably supported by a belt arm 60 which is swingably supported on a shaft 57*a*, which rotates integrally with the belt roller 57, while the belt roller 59 is rotatably supported by a belt arm 61 which is similarly supported swingably on the shaft 57*a*. In addition, a torsion spring (not shown) is inserted between the belt arm 60 and the belt arm 61, and the belt arm 61 is provided with a tension coil spring 62 so that the upper conveyor belt 52 is brought into close contact with the lower conveyor belt 51. Furthermore, the belt arm 61 is provided with a belt roller 62*a* so as to bend the traveling route of the conveyor belt 52 as shown in FIG. 4. Incidentally, a torsion spring denoted by reference numeral 61*a* in the drawing functions to lightly hold the banknotes S by rotating counterclockwise when the belt arm 61 is raised and the clamping of the banknotes S by means of the conveyor belts 51, 52 is released, as will be described later.

Timing pulleys 63, 64 are secured to the end of the shaft 55*a* of the belt roller 55 and the end of the shaft 57*a* of the belt roller 57, respectively, as shown in FIG. 3. A drive belt 69 consisting of a double-sided timing belt or the like similar to the drive belt 28 is mounted around these timing pulleys 63, 64 and the timing pulleys 65 to 68.

As shown in FIG. 4, a cam mechanism which changes over the operations of receiving and dispensing the banknotes by operating the shutter 54 and the conveyor belt 52 in an interlinking relationship is provided in the upper position of the belt arm 61. The cam mechanism is constituted by the following: a cam 71 rotating with and about the shaft 70 of a shutter motor (not shown), belt-operating arms 74A, 74B and a shutter-operating arm 75 respectively operated by the cam 71 in such a manner as to swing with and about the shafts 72, 73.

Both the belt-operating arms 74A, 74B swing integrally with the shaft 72 (swing with the shaft 72 as center in a state in which a relative angle is maintained at a fixed level), and are arranged such that, by pressing the cam follower 76 provided on the end of the belt-operating arm 74B against the cam 71, the end of the belt-operating arm 74A pushes upwardly a pin 61*b* located at the end of the belt arm 61, thereby raising the belt arm 61 while rotating the same clockwise as viewed in FIG. 4, so as to move the upper conveyor belt 52 on the side of the dispensing port 53 away from the lower conveyor belt 51.

In addition, the shutter-operating arm 75 is rotated counterclockwise as viewed in FIG. 4 by the pressing of a cam follower 77 provided at one end portion thereof against the cam 71, and has the function of pressing a pin 54*a* provided on the upper portion of the shutter 54 in such a manner as to depress the same downwardly. Incidentally, the shutter 54 is urged upwardly by means of a tension coil spring 54*b*, and a clockwise rotating moment as viewed in FIG. 4 is applied to the shutter-operating arm 75 by the urging of this tension coil spring 54*b*, thereby bringing the cam follower 77 to come into close contact with the cam 71.

In addition, reference numerals 78 to 81 in FIG. 4 each denote photosensors. The photosensors 78 performs detection at a receiving and delivering portion between the distributing mechanism 1 and the dispensing port mechanism 4A (or 4B); the photosensors 79, 80 each detect relevant portions along the banknote conveying passages in the dispensing port mechanisms 4A, 4B; and the photosensor 81 detects the passage of the banknotes through the dispensing port 53. Moreover, reference numerals 82, 83 denote guide plates for guiding from above and below the banknotes being conveyed by the conveyor belts 51, and 52.

The operation of the banknote dispensing machine having the above-described arrangement will now be described.

(i) As shown in FIG. 2, this banknote dispensing machine is arranged such that the distributing mechanism is disposed in the rear of the dispensing port mechanism 4A, and the machine starts a dispensing operation on condition that the conveyor belts 16, 17, or the drive belt 28 and the like are in the state shown in FIGS. 3 and 4.

(ii) When the banknote S of the specified amount (the amount and denomination specified by the operator) are fed out horizontally from the banknote dispensing machine body 3, the banknotes S first change the photosensor 47 to a light-shielded state (this state will hereafter be called the OFF state, and the light-transmitting state, the ON state), which in turn causes the drive motor 29 to operate so as to drive the timing pulleys 26, 27. The rotation of these timing pulleys 26, 27 causes the belt pulleys 18, 20 to be driven, which in turn causes the conveyor belts 16, 17 to start running, and the banknotes are clamped between these conveyor belts 16, 17 and are taken in by the distributing mechanism 1.

(iii) When all the banknotes have been taken into the distributing mechanism 1, the photosensor 47 is turned ON, and the photosensor 48 is turned OFF. In this state, the conveyor belts 16, 17 stop.

(iv) It is determined whether the dispensing instruction has been issued from the dispensing port mechanism 4A or 4B. If the dispensing instruction has been issued from the dispensing port mechanism 4A, the operation proceeds to the next stage. If the dispensing instruction has been issued from the dispensing port mechanism 4B, the moving frame 6 is moved in the axial direction of the slide guide shaft 7 by the operation of the slide motor 13 to a position directly opposite the dispensing port mechanism 4B, and the operation proceeds to the next stage.

Figure 5:
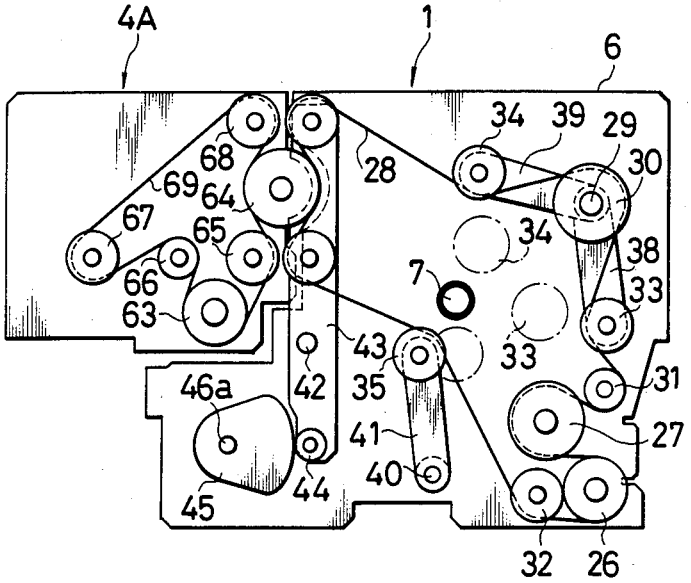
FIGS. 5 and 6 are diagrams explaining the operation of the driving mechanism.

(v) When the cam 45 is rotated 180 degrees from the state shown in FIG. 3 by the operation of the cam-driving motor 46, the riser portion of the cam 45 gradually presses the cam follower 44, and the coupling arm 43 swings counterclockwise as viewed in FIG. 3 about the shaft 42. Consequently, the drive belt 28 assumes a state in which it is brought into close contact with the timing pulley 64. In conjunction with the change in the route of the drive belt 28, the tension arms 38, 39, and 41 are swung from the positions indicated by the chain lines in FIG. 5 to the positions indicated by the solid lines therein by the urging of the respective springs, thereby maintaining the tension of the drive belt 28 at a fixed level. Then, as the drive belt 28 is brought into close contact with the timing pulley 64, the drive system of the distributing mechanism 1 and the drive system of the dispensing port mechanism 4A or (4B) assume a state wherein they are capable of operating in an interlocking relationship.

Figure 6:
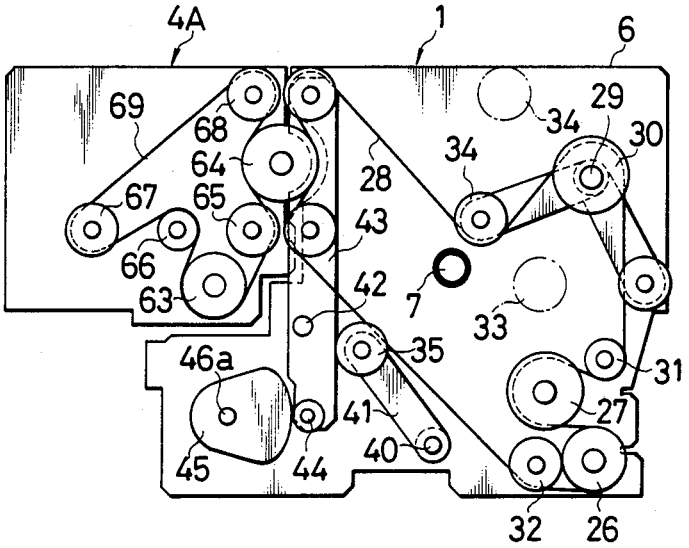

(vi) When the drive motor 29 is operated, the drive system of the distributing mechanism 1 and the drive system of the dispensing port mechanism 4A (or 4B) operate in an interlinking relationship, and the banknotes being conveyed clamped between the conveyors 16, 17 are taken in between the conveyor belts 51, 52. At this time, since the tension applied to the drive belt 28 increases, each tension arm 38, 39, and 41 moves from the position indicated by the solid line in FIG. 5 to the position indicated by the solid line in FIG. 6.

(vii) While the banknotes S are being delivered from the distributing mechanism 1 to the dispensing port mechanism 4A (or 4B), the sensor 78 is OFF. Subsequently, when the banknotes S are conveyed inside the dispensing port mechanism 4A (4B) to a position where the sensor 78 is turned ON and the sensors 79, 80 OFF, the drive motor 29 stops.

(viii) When the cam 71 is rotated 90 degrees by the operation of the shutter motor (not shown), the cam follower 77 moves gradually from the riser portion of the cam 71 to the small-diameter portion thereof, and it becomes possible for the shutter-opening arm 75 to swing clockwise as viewed in FIG. 4. Hence, the shutter 54 is raised upwardly by the resilience of the tension coil spring **54*b*. Since the cam follower 76 provided on the end of the belt-operating arm 74B is still in contact with the small-diameter portion of the cam 71, the upper conveyor belt 52 is maintained in the state shown in FIG. 4**, i.e., the state in which the banknotes are still clamped.

(ix) The belt-driving motor 29 is operated again with the shutter 54 raised, and when the banknotes S are fed to the position where the photosensor 80 is turned ON, the belt-driving motor 29 stops. At this time, the banknotes S are stopped in such a manner as to partially project from the dispensing port 53, and the photosensor 81 is OFF.

(x) When the cam 71 is rotated another 90 degrees (180 degrees from the initial position shown in FIG. 4), the cam follower 76 is pressed by the riser portion of the cam 71, which in turn causes the belt-operating arms 74A, 74B to swing clockwise as viewed in FIG. 4. This causes the belt arm 61 to swing upwardly clockwise as viewed in FIG. 4, and the clamping of the banknotes by means of the upper and lower conveyor belts 51, 52 is released. On the other hand, in conjunction with the raising of the belt arm 61, the end of the torsion spring **61*a* on the side of the dispensing port 53 rotates downwardly to lightly press the rear-end portion of the banknotes S, thereby holding the banknotes S so as to prevent the banknotes S from being scattered. Since the cam follower 77 provided on the end of the shutter-operating arm 75 is still in contact with the small-diameter portion of the cam 71, the shutter 54** is maintained in the open state.

(xi) In this state, if the operator takes out the banknotes S from the dispensing port 53, the sensor 81 is turned ON. When the taking out of the banknotes S is confirmed by the photosensor 81 coming ON, the cam 71 rotates another 90 degrees (i.e., rotates 270 degrees from the initial position), which in turn causes the cam follower 76 to move from the large-diameter portion of the cam 71 to the small-diameter portion thereof. This causes the operating arms 74A, 74B to swing counterclockwise as viewed in FIG. 4, which in turn causes the belt arm 61 to swing such as to be lowered, thereby resetting the upper and lower conveyor belts 51, 52 to the clamping state.

(xii) Finally, when the cam 71 rotates another 90 degrees (i.e., when it returns to its original position by rotating 360 degrees from the initial position), the cam follower 77 is pushed upwardly by the large-diameter portion of the cam 71, which in turn causes the shutter arm 75 to rotate counterclockwise as viewed in FIG. 4 so as to lower the shutter 54, thereby closing the dispensing port 53.

(xiii) On the other hand, when the banknotes are not taken out from the dispensing port 53 after the lapse of a predetermined time, i.e., when a predetermined time has elapsed while the sensor 81 is OFF, it is determined that the operator has forgotten to take out the banknotes, so the cam 71 is rotated 90 degrees as in the case of the above step (xi) (i.e., a state of being rotated 270 degrees from the initial position), thereby closing the shutter 54. At the same time, an alarm (not shown) is issued to call a bank staff member, and an indication is given to the effect that the operation of dispensing banknotes by the dispensing port mechanism 4A (or 4B) which has taken in the banknotes to be dispensed is impossible.

(xiv) After the dispensing operation is completed properly, or after the taking-in operation is completed, the cam 45 is rotated another 180 degrees to reset the same to the state shown in FIG. 3, thereby releasing the interlinking relationship between the drive system of the distributing mechanism 1 and the drive system of the dispensing port mechanism 4A (or 4B). Furthermore, when the distributing mechanism is in a position directly opposing the dispensing port mechanism 4B (i.e., when the dispensing of banknotes to the dispensing port mechanism 4B has been carried out), the distributing mechanism 1 is returned to the position directly opposing the dispensing port mechanism 4A by operating the slide motor 13, thereby setting the machine into readiness for the next dispensing operation.

It is also possible to make an arrangement in which, in place of the alarm referred to in the above step (xiii), the banknotes which the operator has forgotton to take out are returned to the dispensing machine body 3 or to a recovery section (not shown). In other words, it suffices if the cam 71 is rotated to the initial position, as described above, so as to cause the upper and lower conveyor belts 51, 52 to clamp the banknotes, and, after the banknotes are brought back into distributing mechanism 1 by driving the conveyor belts 51, 52 and 16, 17 in the opposite direction, the banknotes may be returned to the dispensing machine body 3 or the recovery section (not shown) while carrying out the process described in the above step (xiv). Parenthetically, if the drive belt is rotated reversely, a tension acting in a direction opposite to the case of dispensing banknotes is applied to the drive belt 28, thereby moving the tension pulleys 33, 34, as shown by the chain lines in FIG. 6.

In the aforementioned embodiment, although a timing belt is employed as a drive belt, it goes without saying that it is also possible to employ other types of transmission belt, such as a flat belt or a chain for transmitting power by virtue of friction between it and the pulley, insofar as they are capable of transmitting power by bringing both obverse and reverse sides thereof into contact with pulleys, sprockets, or the like.

In addition, the number of dispensing port mechanisms need not be restricted to two as in the case of the above-described embodiment; a number of other dispensing port mechanisms may be installed.

Moreover, it goes without saying that the distributing mechanism according to the present invention is applicable to both a dispensing machine which is operated by bank personnel and the like, i.e., one which is installed behind the counter, and a dispensing machine operated by clients, i.e., one which is installed outside the counter.

As is apparent from the foregoing description, since the banknote distributing and dispensing machine is aranged such that the conveyor belt for feeding to the dispensing port mechanism the banknotes dispensed from the dispensing machine body is provided on the moving frame which is movable in the direction of juxtaposition of the plurality of dispensing ports disposed in parallel, the transmitting mechanism for transmitting the power between the drive mechanism of the conveyor belt and the drive mechanism of the conveyor belt for conveying the banknotes in the dispensing port mechanism is provided between the two drive mechanisms, and the route of the drive belts constituting the transmission mechanism is thus made changeable, it becomes possible to connect or disconnect the drive system of the banknote conveyor belt in the plurality of dispensing port mechanisms and the drive system of the banknote conveyor belt in the distributing mechanism. Accordingly, the present invention has advantages in that it becomes unnecessary to install as a driving source a motor in the dispensing port mechanism, so that it becomes possible to reduce the cost of the machine and to increase to as much as practical the number of banknotes that can be dispensed, by securing a sufficient space inside the dispensing port mechanism.

What is claimed is:

1. A banknote distributing and dispensing machine, wherein banknotes are selectively dispensed through one of dispensing ports, said banknote distributing and dispensing machine comprising:

a plurality of dispensing port mechanisms arranged adjacent to each other;

a dispensing port provided in each of said dispensing port mechanisms;

a dispensing machine body for dispensing banknotes;

a distributing mechanism movably mounted between said dispensing port mechanisms and said dispensing machine body for receiving banknotes from said dispensing machine body and transferring the banknotes to one of said dispensing port mechanisms, said distributing mechanism being movable from one position where said distributing mechanism is in alignment with one of said dispensing port mechanisms to another position where said distributing mechanism is in alignment with another of said dispensing port mechanisms;

first conveyor belt means disposed within said distributing mechanism for conveying the banknotes received from said dispensing machine body toward one of said dispensing port mechanisms;

second conveyor belt means disposed within each of said dispensing port mechanisms for conveying the banknotes received from said first conveyor belt means to its respective dispensing port; and transmission means for selectively transmitting movement of said first conveyor belt means to said second conveyor belt means of said dispensing port mechanisms.

2. A machine according to claim 1, wherein said transmission means includes a first group of timing pulleys provided in said distributing mechanism, at least one of said first group of timing pulleys being operatively connected to said first conveyor belt means to drive said first group of timing pulleys synchronous with said first conveyor belt means, a second group of timing pulleys provided in each of said dispensing port mechanisms, at least one of said second group of timing pulleys being operatively connected to said second conveyor belt means to drive said second group of timing pulleys synchronous with said second conveyor belt means, and a coupling arm rotatably mounted in said distributing mechanism and supporting at least one of said first group of timing pulleys for selectively transmitting the movement of said first group of timing pulleys to said second group of timing pulleys.

3. A machine according to claim 2, wherein said coupling arm is driven by a cam and a cam follower.

* * * * *